US005660469A

United States Patent [19]

Seguin

[11] Patent Number: 5,660,469

[45] Date of Patent: Aug. 26, 1997

[54] COVER UNIT FOR AN INDUSTRIAL FOOD MIXER

[76] Inventor: Ronald John Seguin, 904 Cliveden Ave., New Westminster, BC, Canada, V3M 5R5

[21] Appl. No.: 690,939

[22] Filed: Aug. 1, 1996

[51] Int. Cl.[6] ..... B01F 15/00

[52] U.S. Cl. ..... 366/347

[58] Field of Search ..... 366/197–203, 366/207, 347

[56] References Cited

U.S. PATENT DOCUMENTS

| | | | |
|---|---|---|---|
| 1,179,984 | 4/1916 | Vidinghoff | 366/347 |
| 2,014,734 | 9/1935 | Hoe | 366/197 |
| 2,051,883 | 8/1936 | Morgan | 366/197 |
| 2,504,727 | 4/1950 | Post | 366/347 |
| 2,517,648 | 8/1950 | Franke | 366/347 |
| 2,681,211 | 6/1954 | Reynolds . | |
| 2,802,499 | 8/1957 | Tupper . | |
| 2,853,118 | 10/1958 | Perkins . | |
| 3,318,583 | 5/1967 | Wright . | |
| 3,913,896 | 10/1975 | Hawke . | |
| 4,549,811 | 10/1985 | Schniffer . | |
| 4,561,782 | 12/1985 | Jacobsen . | |
| 4,753,534 | 6/1988 | Markle . | |
| 4,900,160 | 2/1990 | Brooks . | |
| 5,104,372 | 4/1992 | Rossetto . | |
| 5,207,506 | 5/1993 | Musseau . | |
| 5,306,083 | 4/1994 | Caldwell et al. | 366/347 |
| 5,348,393 | 9/1994 | Pappas, Jr. | 366/207 |
| 5,472,276 | 12/1995 | Ratermann et al. | 366/203 |
| 5,533,806 | 7/1996 | Veltrop et al. | 366/207 X |

*Primary Examiner*—Charles E. Cooley
*Attorney, Agent, or Firm*—Terry M. Gernstein

[57] ABSTRACT

A cover unit for an industrial food mixer includes two clamshell-like covers that are hingeably mounted at the proximal ends thereof on the mixer to move in a plane that is parallel to the plane containing the top rim of the bowl in which mixing is being carried out. A splash rib is dependently mounted on each cover as is a splash edge. The splash rib and edge are in the forms of compound curves, and an arcuate cutout on one edge of each cover matches with the cutout on the other cover to define an opening through which beater or agitator elements of the mixer extend into the mixing bowl. The covers move between an open condition uncovering the bowl and a closed condition covering the bowl. A lock mechanism is used to maintain the covers in the locked condition.

17 Claims, 5 Drawing Sheets

F
G
Y
M
10
E
B

COVER UNIT FOR AN INDUSTRIAL FOOD MIXER

TECHNICAL FIELD OF THE INVENTION

The present invention relates to the general art of food preparation, and to the particular field of food mixers and accessories therefor.

BACKGROUND OF THE INVENTION

Modern food mixers generally include beater or agitator elements which are placed into a mixing bowl that is rotated during the food preparation process. Industrial mixers can include large beater elements which rotate at high speeds. Hobart Corporation of Troy, Ohio is one manufacturer of this type of mixer.

These food mixers have proved to be quite effective and are well accepted in the art. However, they have several drawbacks, which if overcome, should make them even more effective. For example, these known mixers can be noisy and can have a possibility of elements, such as food or the like, flying out of the mixing bowl during operation. Similarly, foreign, and undesired, material can move into the mixing bowl during use. These are undesirable situations. On the other hand, however, the desired addition or removal of material to or from the mixing bowl should be a retained feature of such machinery.

Therefore, there is a need for a food mixer which reduces noise and the possibility of undesired entry and/or emission of material to and/or from the mixing bowl while still allowing desired addition or removal of material to or from the bowl.

Still further, safety requires that as much precaution as possible be taken to prevent undesired contact between the beater elements and the operator. However, this precaution should be taken without unduly restricting desired contact between the operator and the inside of the mixing bowl or with the beater elements themselves. Such desired contact includes, among others, cleaning of the beater elements.

Therefore, there is a need for a means for preventing undesirable contact between an operator and beater elements of a food mixer without unduly restricting desired contact between an operator and the agitator elements.

Still further, cleaning of the item is an important aspect for any item used in food preparation. The item should be thoroughly cleaned prior to and after use whereby sanitary conditions are effectively established and maintained. Cleaning not only should be thorough but should be efficient, especially from a cost aspect.

Therefore, there is a need for a food mixer that is capable of being efficiently and thoroughly cleaned.

Still further, many businesses have large investments in food mixing equipment and might be reluctant to change. Therefore, to be commercially successful, improvements should be compatible with existing equipment and should be easily retrofit onto existing equipment whereby businesses will be willing to accept the improvements.

Some known food mixers have an open wire mesh cover that fits over the mixing bowl. This type of cover has some advantages over no cover, but has nearly all of the above-mentioned drawbacks are present with such open wire mesh covers. This is especially the situation with industrial food mixers.

OBJECTS OF THE INVENTION

It is a main object of the present invention to provide a cover for a food mixer which reliably and essentially completely covers a mixing bowl.

It is another object of the present invention to provide a cover for an industrial food mixer which reliably and essentially completely covers a mixing bowl.

It is another object of the present invention to provide a cover for an industrial food mixer which prevents the entry of foreign material into the mixing bowl.

It is another object of the present invention to provide a cover for an industrial food mixer which prevents material being processed in a mixing bowl from undesirably exiting the bowl during the mixing process.

It is another object of the present invention to provide a cover for an industrial food mixer which reduces the possibility of undesired contact between the mixing elements and the operator.

It is another object of the present invention to provide a cover for an industrial food mixer which is securely mounted.

It is another object of the present invention to provide a cover for an industrial food mixer which reduces the noise associated with the mixer.

It is another object of the present invention to provide a cover for an industrial food mixer which permits the easy addition of material to a mixing bowl.

It is another object of the present invention to provide a cover for an industrial food mixer which is easily retrofit onto an existing mixer.

It is another object of the present invention to provide a cover for an industrial food mixer which is efficiently cleaned.

It is another object of the present invention to provide a cover for an industrial food mixer which is easily mounted and demounted.

SUMMARY OF THE INVENTION

These, and other, objects are achieved by a cover for a food mixer which is impervious to the food being mixed in a bowl on which the cover is being used. The cover includes two clamshell shaped guard covers which are hingeably mounted adjacent to their proximal ends on the mixer. A lock means is located on the distal ends of the guard covers. Each cover has two arcuate side edges, with an arcuate cutout defined in one side edge and a splash rib dependingly mounted near the other side edge to be located outwardly adjacent to the top rim of the bowl. A guard element is dependingly mounted on each guard cover to be outwardly adjacent to the splash rib with respect to the bowl whereby both the guard element and the splash rib are located outside of the bowl when the cover is closed.

The guard covers pivot in a plane that is parallel to the plane containing the top rim of the mixing bowl between a closed condition covering the bowl and an open condition uncovering the bowl. Mixing elements or beating elements can extend into the mixing bowl through an opening defined by the two arcuate cutout portions when the cover guards are in the closed condition.

In the open condition, food, ingredients, or the like, can easily be inserted into or withdrawn from the mixing bowl. The beating elements can also be contacted for cleaning or the like. However, the cover can easily be moved into the closed condition at any time. Once closed, food, and the like, remains trapped in the bowl, noise is reduced, no foreign matter is likely to enter the bowl and the operator is protected from contact either with the ingredients being mixed or with the mixing elements. However, the easy movement of the cover back into the open condition permits addition of ingredients or sampling, or inspection of the food being processed. When closed, the operator is protected both form the mixing elements and from ingredients flying out of the bowl.

The cover is easily removed for cleaning and is easily mounted on an existing food processor in the case of a retrofit.

The curved shape of the guard elements as well as,the curved and tapering nature of the splash ribs provide strength and lightness and yet neither the splash ribs nor the guard elements interferes with movement or operation of the cover unit. The thickness of the outside edge mounted guard elements changes from a maximum near the area of most stress to the a minimum near the area of least stress whereby strength considerations are factored into cost considerations. The guard elements are curved in two directions to match the compound curve of the outside edge of the guard cover, which includes an arcuate section and an ear on the proximal end thereof.

BRIEF DESCRIPTION OF THE DRAWING FIGURES

DETAILED DESCRIPTION OF THE PREFERRED EMBODIMENT OF THE INVENTION

Figure 1:
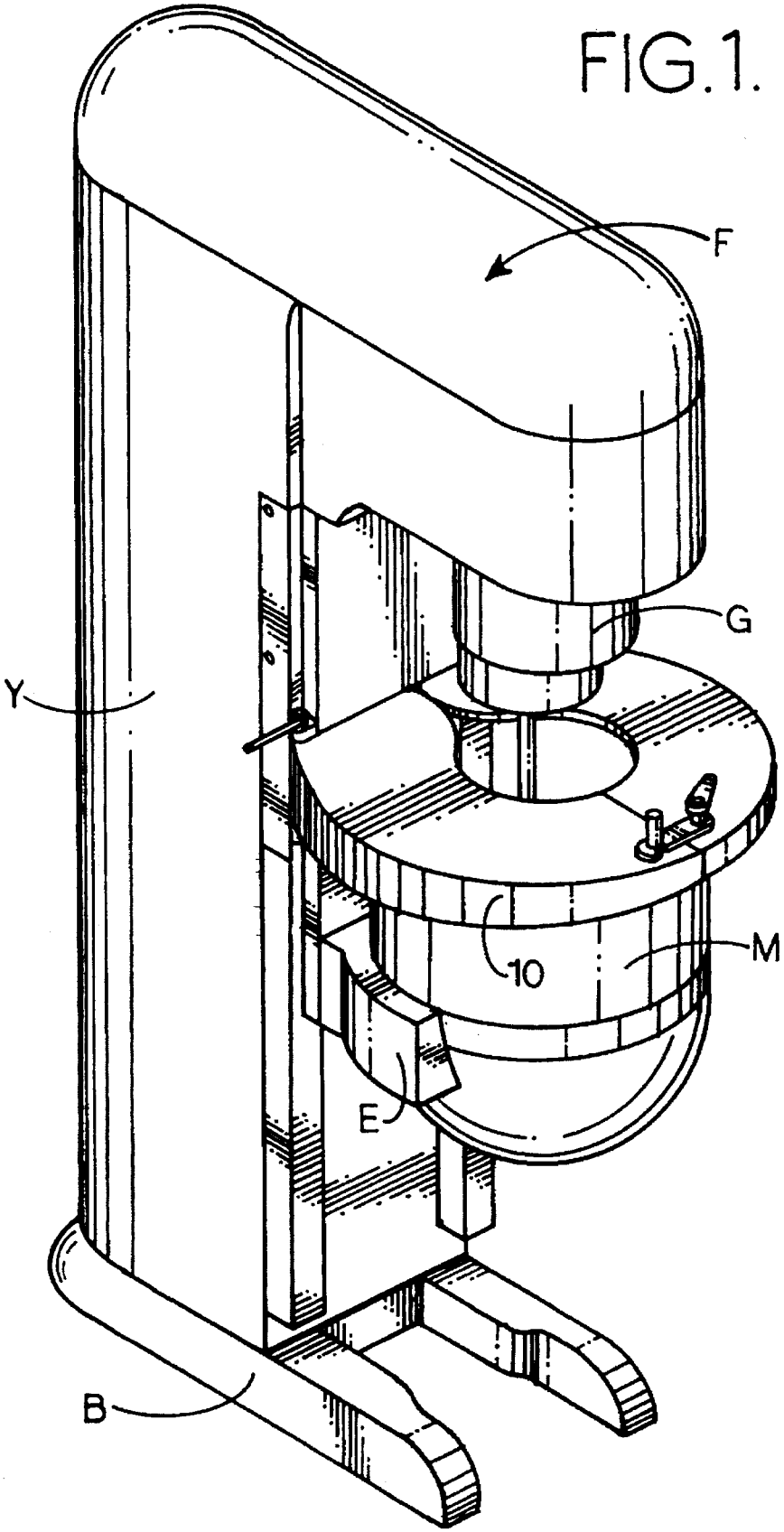
FIG. 1 is a side perspective view showing the cover of the present invention on an industrial food mixer, with the cover in the closed condition.
Figure 2:
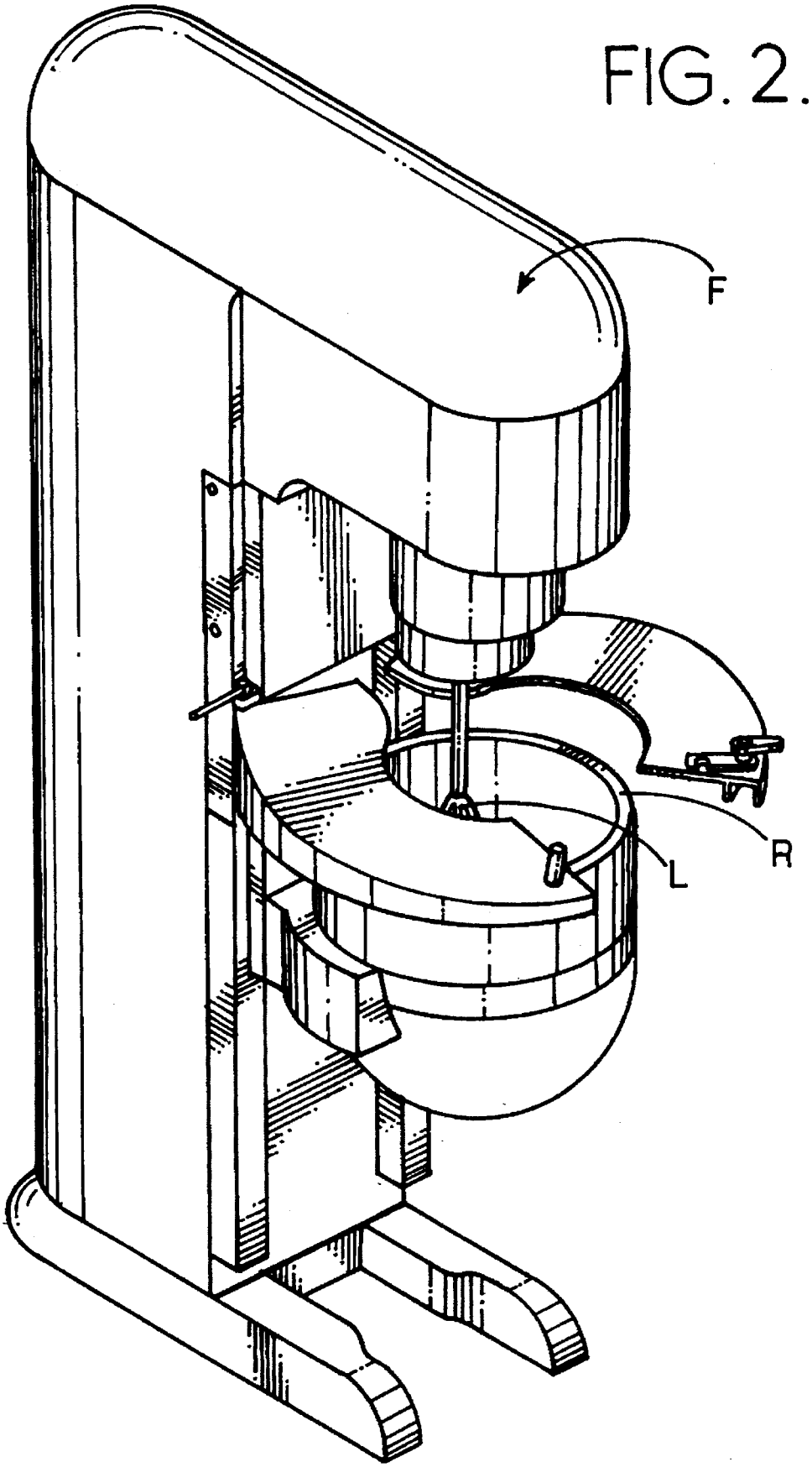
FIG. 2 is a front perspective view showing the cover of the present invention on an industrial mixer, with the cover in an open condition.

Shown in FIGS. 1 and 2 is an industrial food mixer F that is suitable for use in connection with a cover unit 10 that is the subject of the present invention. Cover unit 10 can be installed by the manufacturer or can be retrofit as will be understood from the teaching of the following disclosure. Preferably, the cover unit 10 is formed of stainless steel but other materials can also be used without departing from the scope of this disclosure. Food mixer F includes a base B, with a body Y on which a mixing bowl M is mounted for rotation via a yoke E. As is the case with industrial mixers, food is prepared in mixing bowl M by adding ingredients to that bowl and removing finished product therefrom. Beater or agitator unit G includes beater or agitators that are located inside bowl M to beat, knead or mix food in that bowl as is well known to those skilled in the art.

Cover unit 10 is shown in FIG. 1 in the closed condition which will reduce noise, prevent undesirable material from passing into or out of mixing bowl M and will protect an operator from undesired contact with the beater or agitator elements. Cover unit 10 moves in a divercated manner in a plane that is parallel to a plane containing top rim R (see FIG. 2) of mixing bowl M from the FIG. 1 closed condition to an open condition shown in FIG. 2. The open condition exposes the inside of the mixing bowl as well as beater elements L to access by the operator. Food may be removed from the bowl, or ingredients added to the bowl in the FIG. 2 open condition of cover unit 10.

Figure 3:
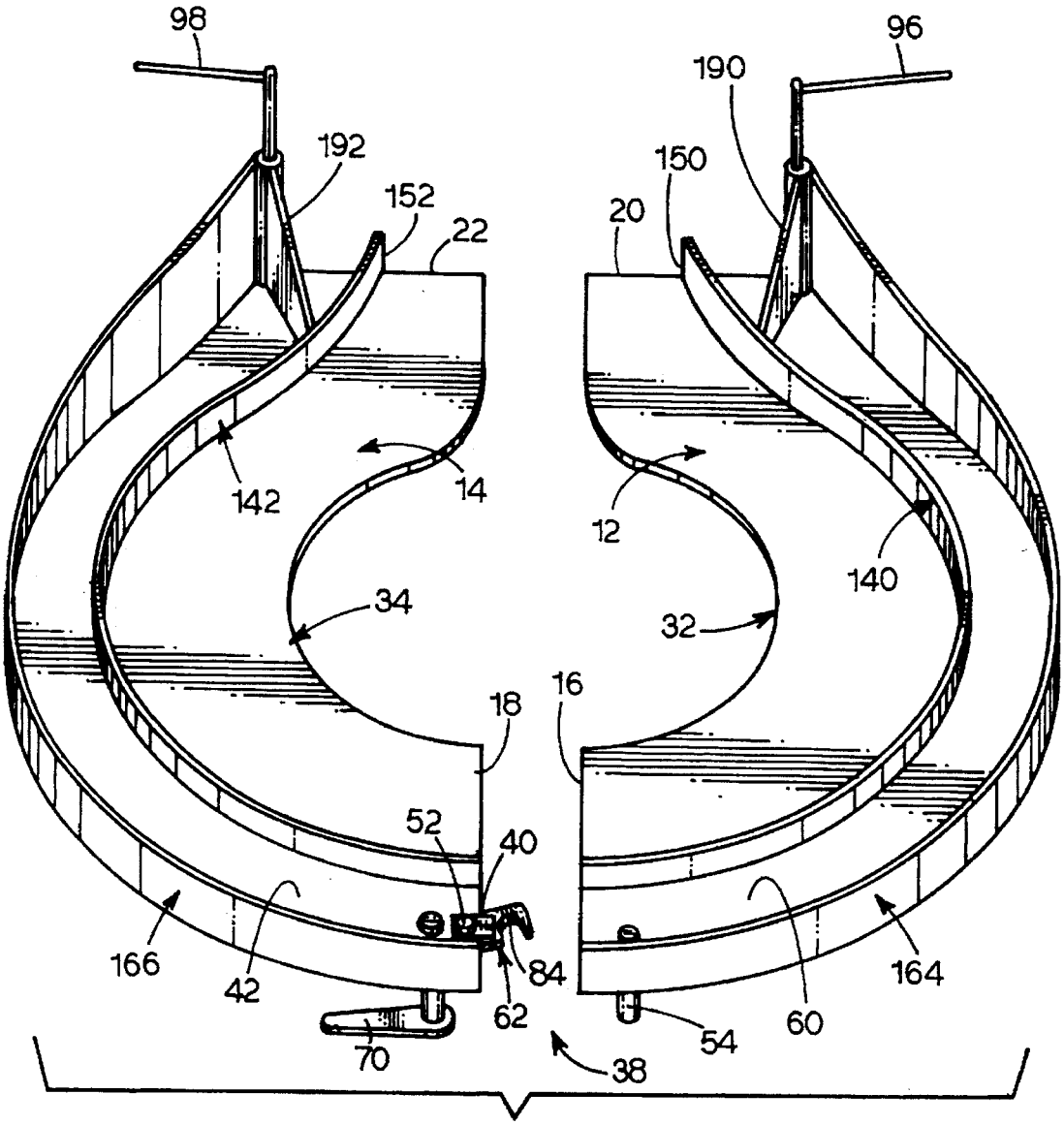
FIG. 3 is a top perspective view of the cover in a closed condition.
Figure 4:
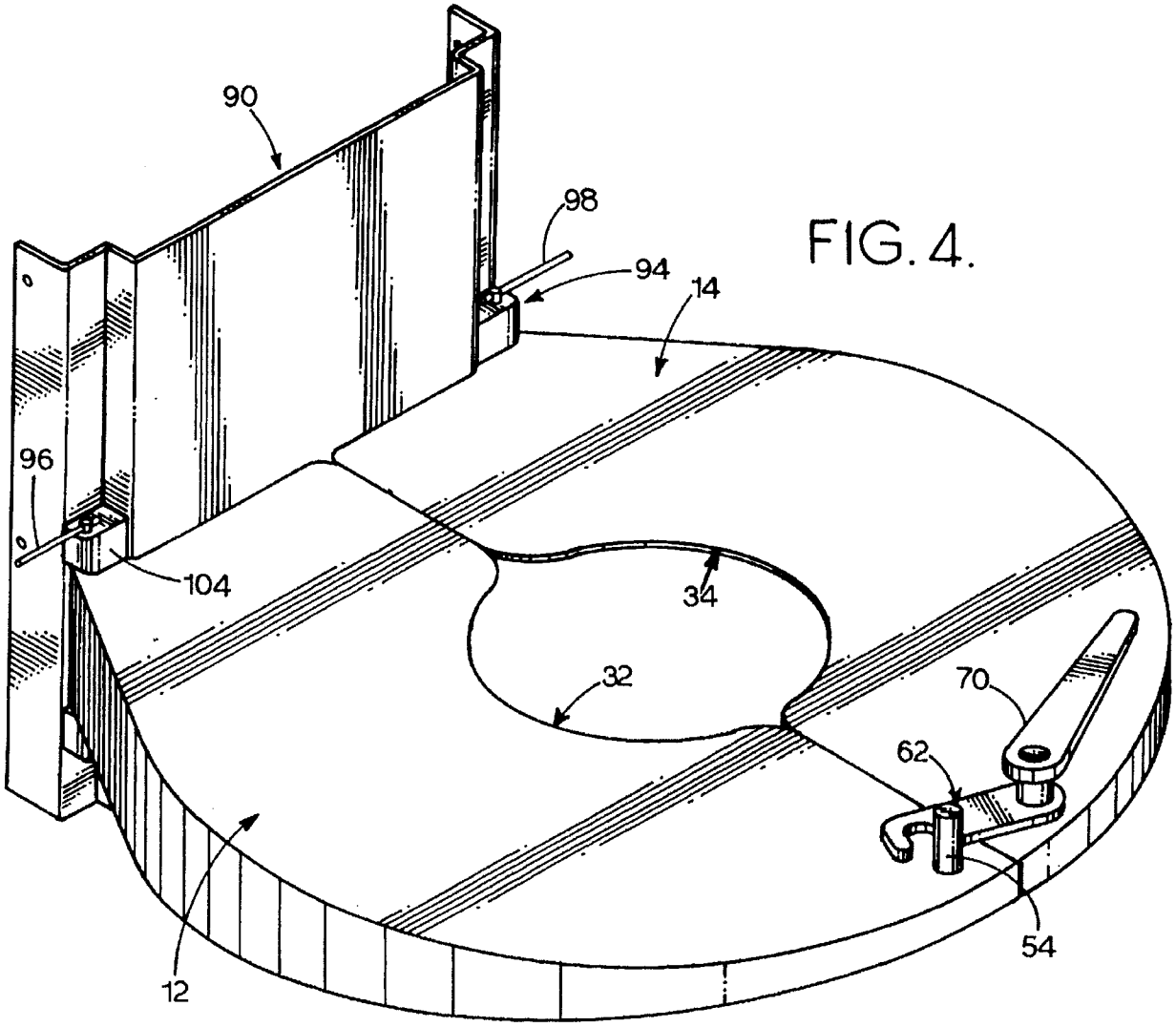
FIG. 4 is a bottom perspective view of the cover.
Figure 5:
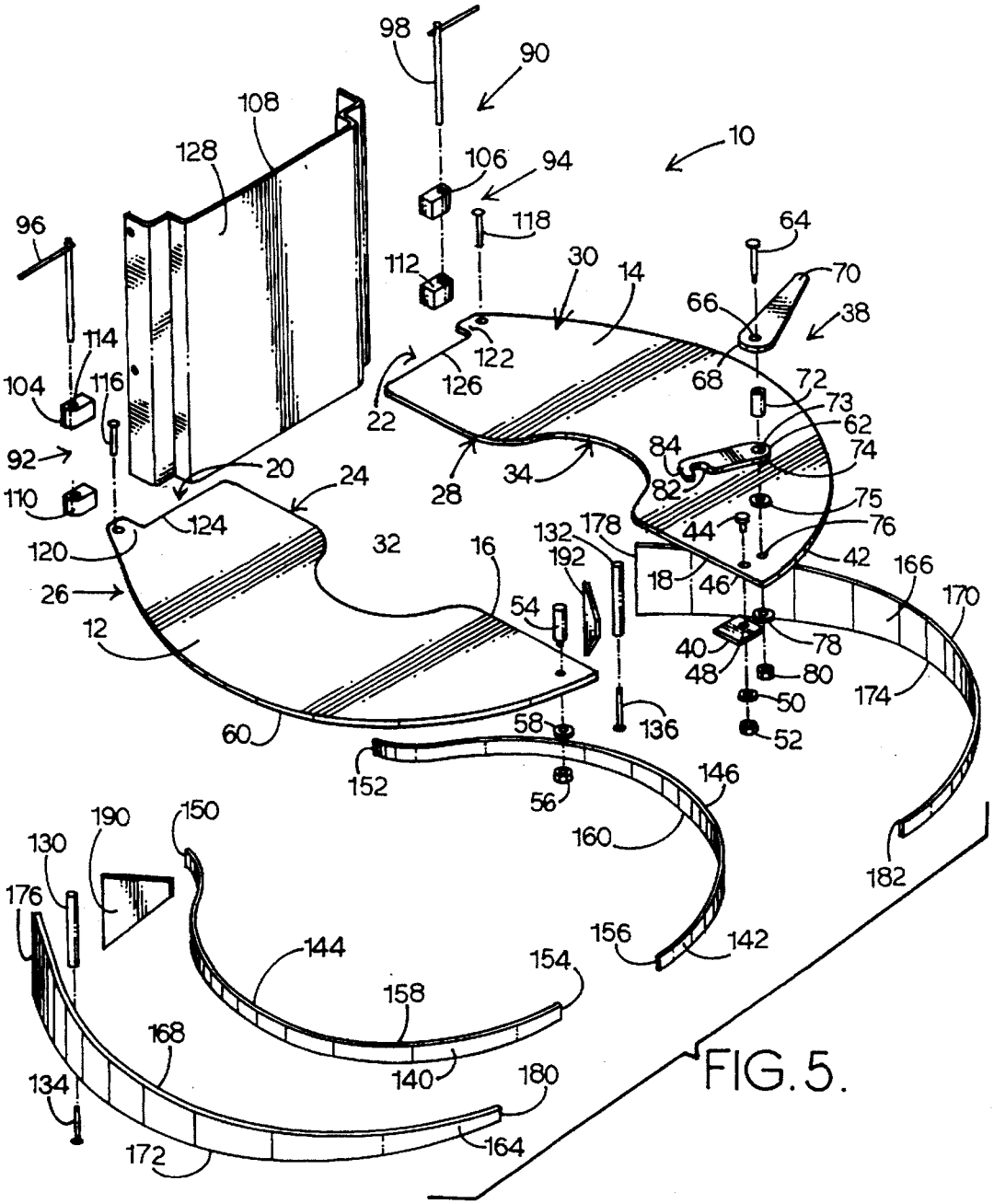
FIG. 5 is an exploded perspective view of the cover.

Referring to FIGS. 3–5, it is seen that cover unit 10 includes first and second guard covers 12 and 14 which are impervious to ingredients being mixed in bowl so that food does not undesirably fly out of the bowl during the mixing process. Each guard cover has a distal end, ends 16 and 18, a proximal end, ends 20 and 22, side edges, edges 24, 26 and 28, 30 connecting the distal and proximal ends, and an arcuate cutout portion, portions 32 and 34 in side edges 24 and 28 between the proximal and distal ends. The arcuate cutout portions co-operate with each other to define an opening O through which the beater or agitator elements fit into the bowl when the cover unit is in the closed condition. The guard covers are pivotally mounted at their proximal ends to move in a divercated manner with the distal ends moving toward and away from each other so that all edges of guard cover 12 are spaced from corresponding edges of guard cover 14 in the fully open condition of unit 10 and corresponding edges, such as edges 24 and 28, and 16 and 18 contact each other when the cover unit is fully closed (see FIG. 1).

The cover unit further includes a locking means 38 on the distal ends the guard covers for releasably locking the distal end 16 of first guard cover 12 to the distal end 18 of second guard cover 14 to maintain the guard covers in the closed condition when desired but to release covers 12 and 14 when it is desired to open the cover unit.

The preferred form of lock means 38 includes a guide plate 40 mounted on undersurface 42 of guard cover 14 adjacent to the distal end 18 thereof by a counter sunk screw 44 extending through aligned holes 46 in cover 14 and 48 in guide plate 40, and through washer and into lock nut 52 to secure the guide plate to the guard cover. Lock means 38 further includes a lock pin 54 mounted on guard cover 12 adjacent to the distal end 16 by a lock nut 56, with a washer 58 interposed between the lock nut and undersurface 60 of guard cover 12. The lock pin is located to be engaged by a lock plate 62 when the lock means is engaged and to be spaced from that lock plate when the lock means is open. Lock plate 62 is rotatably mounted on guard cover 14 adjacent to distal end 18 by a shoulder bolt 64 extending through a hole 66 defined in a proximal end 68 of a handle 70 and through a bore in a shaft 72, a hole 73 in lock plate 62 near proximal end 74 thereof, a washer 75, a hole 76 in guard cover 14 near distal end 18, a washer 78 and into a lock nut 80 whereby the handle 70 is locked to the lock plate 62 and to the guard cover 14 to move lock plate 62 from an open condition to a locking condition with arcuate cutout 82 in the lock plate near distal end 84 thereof into contact with lock pin 54 to lock the guard covers together in the FIG. 2 condition or to move the lock plate to disengage that lock plate from the lock pin 54 to open the lock means.

The lock means is preferably formed of a material that is compatible with the function of the mixer, and which is easily cleaned. Therefore, while the form of lock means 38 is discussed above is preferred, other forms will occur to those skilled in the art based on the teaching of the present disclosure. A preferred form of lock means 38, along with the other elements of cover unit 10 is stainless steel.

Cover unit 10 is releasably mounted on the food mixer by a mounting means 90 (best shown in FIG. 5) which includes a hinge means 92, 94 associated with each guard cover and mounted on the food mixer so the guard cover can be moved as discussed above and so the guard covers can be easily removed for cleaning. The mounting means also is easily retrofit onto an existing food mixer. The hinge means further includes a hinge pin, pins 96 and 98, and hinge pin receiving means on the proximal end of each guard cover for receiving a hinge pin to pivotally attach each guard cover to the food mixer via the mounting means so that each of said guard covers pivots between the FIG. 2 open condition with the distal ends spaced apart and a FIG. 1 closed condition with the distal ends closely adjacent to each other. The hinge pin receiving means include a top hinge block, blocks 104 and 106, mounted on a mounting plate 108 that is fixed to the mixer body Y, and a bottom hinge block, blocks 110 and 112, also mounted on the mounting plate 108 in a location below the top hinge blocks. The hinge blocks have bores, such as bore 114, defined therethrough which accommodate the hinge pins. The hinge pins are L shaped for easy insertion and removal.

The hinge pins fit through bushings 116 and 118 that are mounted in ears 120 and 122 on proximal ends 20 and 22 of the guard covers adjacent to steps 124 and 126 which abut front surface 128 of mounting plate 108 when the cover unit is closed and are received in the top ends of hinge tubes 130, 132 which are closed at the other ends thereof by bottom bushings 134 and 136. The hinge pins thus pivotally attach the guard covers to the food mixer via the mounting plate and the blocks.

Each guard cover further includes a splash rib, ribs 140 and 142, pendently mounted on the undersurface of each guard cover at a top edge 144, 146 of each rib. Each splash rib has a proximal end, ends 150 and 152, intersecting the proximal end of the guard cover on which the splash rib is mounted and a distal end, ends 154 and 156, intersecting the distal end of the guard cover on which the splash rib is mounted, with a doubly curved body, bodies 158 and 160, therebetween. The bodies are curved in two directions so they will not interfere with the mixing bowl. The splash ribs are located on the guard covers to be outwardly adjacent to the mixing bowl when the cover unit is closed.

Each guard cover further includes a guard element, elements 164 and 166, pendently mounted on each guard cover at a top end 168, 170 thereof at side edges 26 and 30 to be located outwardly adjacent to the splash ribs. Each guard element has a lower edge, edges 172 and 174, and a thickness measured between the top and lower edges. Each guard element further includes a proximal end, ends 176 and 178, located adjacent to the proximal ends 20 and 22 of the guard covers and a distal end, ends 180 and 182, located adjacent to the distal ends of the guard covers.

The guard elements are arcuate and the thickness thereof decreases from a maximum adjacent to proximal ends 176, 178 where stresses are the highest to a minimum adjacent to distal ends 180, 182 where the stresses are the lowest. This tapering permits the guard elements to make efficient use of material to add support to the guard covers while also acting as splash guards. Preferably, the guard elements are stainless steel to make cleaning easier, and are in the form of a compound curve to match the curved configuration of arcuate side edges 26 and 30 and the ear elements 120 and 122.

Further support to the guard covers is provided by support ribs 190 and 192 located adjacent to the proximal ends of the guard covers and adjacent to the mounting means. Support ribs 190, 192 extend between the guard elements and the splash ribs as is best seen in FIG. 3.

It is understood that while certain forms of the present invention have been illustrated and described herein, it is not to be limited to the specific forms or arrangements of parts described and shown.

I claim:

1. A cover unit for a food mixer comprising:

A) first and second guard covers, each guard cover having a distal end, a proximal end, and an arcuate cutout portion between said proximal and distal ends, said guard covers being impervious to ingredients being mixed by a food mixer associated with said guard covers;

B) a locking means on the distal end of each guard cover for releasably locking the distal end of said first guard cover to the distal end of said second guard cover;

C) mounting means for mounting said guard covers on the food mixer, said mounting means including (1) hinge means for mounting each guard cover on the food mixer, (2) a hinge pin in each of said hinge means, and (3) hinge pin receiving means on the proximal end of each guard cover for receiving the hinge pin of one of said hinge means to pivotally attach each guard cover to the food mixer via said mounting means so that each of said guard covers pivots on the food mixer between an open condition with said distal ends spaced apart and a closed condition with said distal ends closely adjacent to each other; and D) a splash rib mounted on each guard cover.

2. The cover unit defined in claim 1 further including two arcuate side edges on each said guard cover, one of said splash ribs being located between said side edges of each said guard cover, one of said arcuate cutout portions being located in one of said side edges of each said guard cover.

3. The cover unit defined in claim 2 further including a guard element on each guard cover on the other side edge.

4. The cover unit defined in claim 3 wherein each splash rib has a proximal end intersecting the proximal end of the guard cover on which said splash rib is mounted and a distal end intersecting the distal end of the guard cover on which said splash rib is mounted.

5. The cover unit defined in claim 4 wherein each splash rib is curved in two directions.

6. The cover unit defined in claim 4 wherein each guard element is in the form of a compound curve.

7. The cover unit defined in claim 3 wherein said mounting means further includes a mounting plate on the food mixer with said hinge means being mounted on said mounting plate.

8. The cover unit defined in claim 7 wherein said hinge means includes an ear on the proximal end of each guard cover, and a step on the proximal end of each guard cover which is closely adjacent to said mounting plate when said guard cover is in said closed condition.

9. The cover unit defined in claim 3 wherein said hinge means includes a top hinge block and a bottom hinge block.

10. The cover unit defined in claim 3 further including a support rib on each guard cover extending from the guard element to the splash rib.

11. The cover until defined in claim 10 wherein each support rib is located adjacent to the proximal end of each said guard cover.

12. The cover unit defined in claim 3 wherein each of said guard elements has a proximal end adjacent to the proximal end of the guard cover to which it is attached and a distal end adjacent to the distal end of the guard cover to which it is attached, said guard elements being pendently attached at a top edge to said guard covers with a thickness measured between said top edge and a bottom edge, said thickness decreasing from adjacent to the proximal end of said guard element to the distal end of said guard element.

13. The cover unit defined in claim 1 wherein said locking means includes a handle and a lock plate on said handle, means for pivotally attaching said handle to said first guard cover so that said lock plate moves between a locked condition and an unlocked condition, and a lock pin mounted on said second guard cover in position to be releasably engaged by said lock plate when said lock plate is in said locked condition.

14. The cover unit defined in claim 13 wherein said locking means further includes a guide plate mounted on said first guard cover.

15. The cover unit defined in claim 1 wherein each guard cover has a curved shape.

16. The cover unit defined in claim 15 wherein the curved shape of each guard cover is compound.

17. The cover unit defined in claim 1 further including a mixing bowl in which food is processed and which is covered by said guard covers in the closed condition, said mixing bowl having a top rim, said guard covers being mounted to move in a plane parallel to a plane containing said top rim.

* * * * *